US007117787B2

(12) United States Patent
Thomas et al.

(10) Patent No.: US 7,117,787 B2
(45) **Date of Patent: *Oct. 10, 2006**

(54) MULTI-FRAME SCREEN PRINTING

(75) Inventors: Carrie L. Thomas, Lawrence, KS (US); Catherine Wynkoop, Topeka, KS (US); Kevin Townsend, Topeka, KS (US)

(73) Assignee: Hallmark Cards, Incorporated, Kansas City, MO (US)

( * ) Notice: Subject to any disclaimer, the term of this patent is extended or adjusted under 35 U.S.C. 154(b) by 0 days.

This patent is subject to a terminal disclaimer.

(21) Appl. No.: 11/095,024

(22) Filed: Mar. 31, 2005

(65) Prior Publication Data

US 2005/0229797 A1 Oct. 20, 2005

Related U.S. Application Data

(63) Continuation of application No. 10/278,056, filed on Oct. 22, 2002, now Pat. No. 6,910,414.

(60) Provisional application No. 60/369,684, filed on Apr. 2, 2002, provisional application No. 60/339,602, filed on Oct. 22, 2001.

(51) Int. Cl.
*B41C 1/14* (2006.01)

(52) U.S. Cl. ..... 101/128.4; 101/115; 101/127.1; 101/129; 219/121.7

(58) Field of Classification Search ..... 101/115, 101/127.1, 128, 128.4, 129; 430/308; 219/121.7
See application file for complete search history.

(56) References Cited

U.S. PATENT DOCUMENTS

| | | | |
|---|---|---|---|
| 25,481 | A | 9/1859 | Bigelow |
| 37,648 | A | 2/1863 | Sumner |
| 3,921,522 | A | 11/1975 | Zimmer |
| 3,992,989 | A | 11/1976 | Thompson et al. |
| 4,203,360 | A | 5/1980 | Madwed |
| 4,275,655 | A | 6/1981 | Artaud et al. |
| 4,345,390 | A | 8/1982 | Newman |
| 4,351,469 | A | 9/1982 | Newman |
| 4,516,495 | A | 5/1985 | Ericsson |
| 4,750,421 | A | 6/1988 | Lucas |
| 4,813,351 | A | 3/1989 | Pierson, Jr. |
| 4,843,963 | A | 7/1989 | Hoeflein et al. |
| 4,852,483 | A | 8/1989 | Bussard |
| 5,144,899 | A | 9/1992 | Allen |
| 5,163,367 | A | 11/1992 | Newman |
| 5,193,457 | A | 3/1993 | Hahn et al. |

(Continued)

FOREIGN PATENT DOCUMENTS

| | | |
|---|---|---|
| FR | 1.520.007 | 4/1968 |

*Primary Examiner*—Ren Yan
(74) *Attorney, Agent, or Firm*—Fish & Richardson P.C.

(57) ABSTRACT

A method of making screen printing frames can include, in certain illustrative embodiments, affixing at least two frames to one another, applying a masking film to both frames, exposing the frames, removing the unhardened emulsion in the meshes, and separating the frames from one another for deployment in a screen printing apparatus. This exemplary process can be used to create images in substantially complete registration with one another on frames having different mesh counts. Stated another way, these embodiments permit the use of multiple frames to print different inks through different meshes in a single pass to form images in substantially complete registration with one another. In certain preferred embodiments, a screen printing apparatus can include two frames, each having a mesh with a different pitch, wherein the frames are adapted to receive different inks and held in fixed register during a screen printing operation.

20 Claims, 8 Drawing Sheets

U.S. PATENT DOCUMENTS 5,334,815 A 8/1994 MacNaughton et al.
5,343,804 A 9/1994 Karlyn et al.
5,377,422 A 1/1995 Newman
5,450,789 A 9/1995 Hasegawa
5,487,340 A 1/1996 Kanai
5,522,148 A 6/1996 Newman
5,632,200 A 5/1997 Fukai
5,648,189 A 7/1997 Newman
5,685,221 A 11/1997 Newman
5,692,438 A 12/1997 Kanai
5,775,220 A 7/1998 Thatcher
5,797,317 A 8/1998 Lahat et al.
5,847,689 A 12/1998 Elliot
5,960,712 A 10/1999 Jiang et al.
6,066,206 A 5/2000 Doyle et al.
6,189,448 B1 2/2001 O'Neal et al.
6,694,875 B1 2/2004 Takahashi et al.

MULTI-FRAME SCREEN PRINTING

CROSS-REFERENCE TO RELATED APPLICATION

This application is a continuation application of U.S. application Ser. No. 10/278,056, filed Oct. 22, 2002 now U.S. Pat. No. 6,910,414 by Thomas et al., entitled "Multi-Frame Screen Printing," which claims the benefit of U.S. provisional application Ser. No. 60/339,602, filed Oct. 22, 2001 by Thomas et al., entitled "Multi-Frame Screen Printing," and U.S. provisional application Ser. No. 60/369,684, filed Apr. 2, 2002 by Thomas et al., entitled "Multi-Frame Screen Printing." The disclosure of the aforementioned applications is incorporated herein by reference in its entirety.

FIELD OF THE INVENTION

This invention relates primarily to screen printing. Certain embodiments involve a screen printing apparatus having multiple frames wherein different inks are printed through each mesh.

BACKGROUND

Screen printing processes are typically used to produce images on materials such as textiles and paper. Images can be produced by forcing colored liquids such as inks through a screen or mesh with a rubber blade. The type and consistency of the inks and substrate dictate the type and configuration of the mesh. Solvent-based inks, for example, can be printed with screens having a relatively low mesh count, which corresponds to the number of openings in the screen mesh per lineal inch. Conversely, other solutions such as UV-based inks can be screen printed through meshes having a relatively large mesh count. The pitch of a screen, or the distance between adjacent wires or threads in the mesh, is inversely related to the mesh count.

Accordingly, in processes involving the printing with more than one type of ink, it is often necessary to substitute screens between ink applications. For instance, a higher pitch screen may be used with a more viscous ink to print a first area of a sheet of cardstock with a graphic element, and a lower pitch mesh can be used with a less viscous ink to print text on a second area of the cardstock. Substituting the screens in this fashion expends can be quite time consuming. Moreover, it is often difficult to accurately align the substitute screen in perfect register with the first screen. The alignment process consumes further time and introduces the significant possibility of misalignment of the second printed image relative to the first.

Multiple-frame screen printing has been used to print multiple, different images with a single ink in a single pass. In those systems, however, there is no need to have the images printed by each frame be in register with one another. In fact, such registration generally cannot be achieved due to the fact that each frame is prepared separately and individually. Moreover, these systems have the same type of mesh in adjacent frames because only a single type of ink is used. Accordingly, these apparatus are not suitable for printing works wherein multiple images must be printed with different meshes yet remain in register.

SUMMARY

A method of making screen printing frames can include, in certain illustrative embodiments, affixing at least two frames to one another, applying a masking film to both frames, exposing the frames, removing the unhardened emulsion in the meshes, and separating the frames from one another for deployment in a screen printing apparatus.

This exemplary process can be used to create images in substantially complete registration with one another on frames having different types and mesh counts. Stated another way, these embodiments permit the use of multiple frames to print inks through different meshes in a single pass to form images in substantially complete registration with one another.

In certain preferred embodiments, a screen printing apparatus can include two frames, each having a mesh with a different pitch, wherein the frames are adapted to be held in fixed register during a screen printing operation.

The details of one or more embodiments of the invention are set forth in the accompanying drawings and the description below. Other features, objects, and advantages of the invention will be apparent from the description and drawings, and from the claims.

DESCRIPTION OF DRAWINGS

Like reference symbols in the various drawings indicate like elements.

DETAILED DESCRIPTION OF ILLUSTRATIVE EMBODIMENTS

Figure 1:
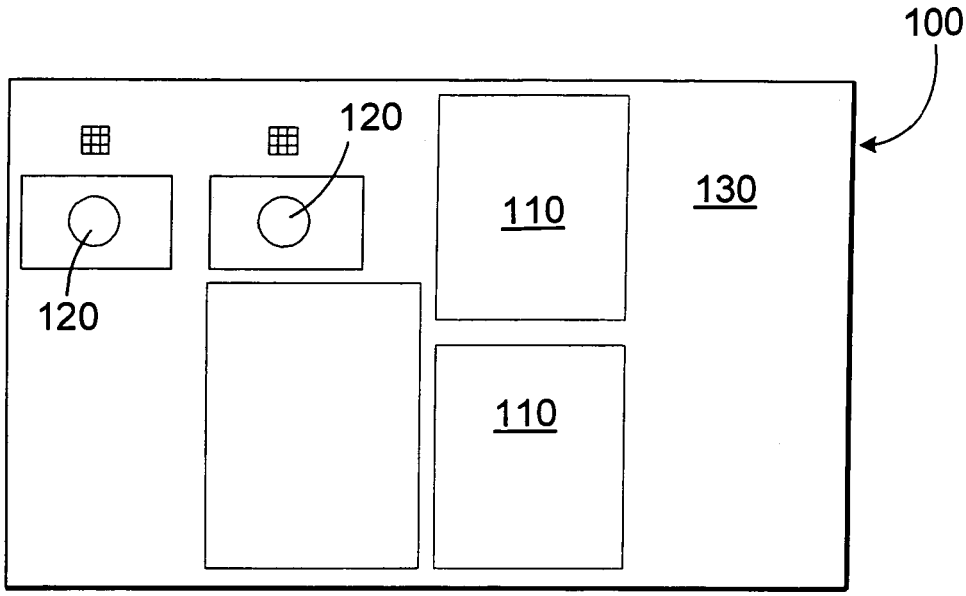
FIG. 1 is a plan view of sheet of stock which is to receive screen printed images.

FIGS. 1–8 are discussed below in a context of an exemplary screen printing process in which two images are to be printed in register in a single pass with different inks. Referring to FIG. 1, a sheet of lithographic stock 100 can include multiple pre-printed indicia 110. The stock 100 can include first regions 120 that can be printed with a UV ink which requires a mesh having a first count, such as 305 mesh. The stock 100 can also include a second region 130 which is to be printed with a solvent based ink that requires a screen having a second mesh count, such as 195 mesh. By way of example, text could be printed with the 195 mesh whereas images could be printed with the 305 mesh. The stock and images or indicia in this embodiment have been laid out in a fashion that permits a screen printing operation to be performed thereon in one pass instead of two, as will be appreciated from the following description.

Figure 2:
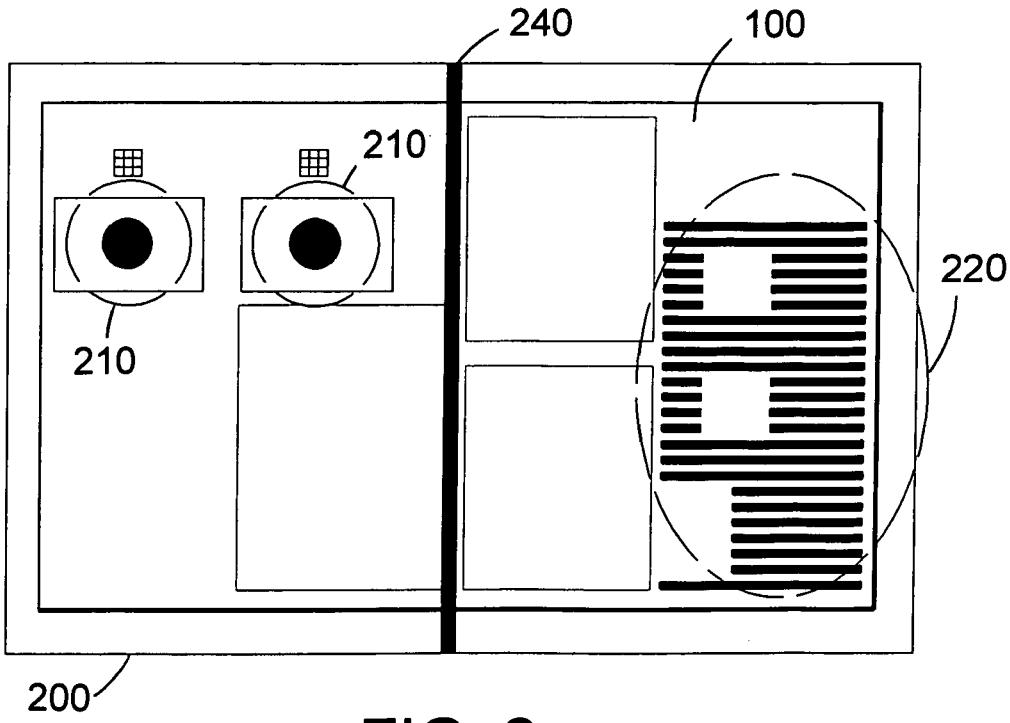
FIG. 2 is a plan view of a sheet of stock a masking film applied thereto.

Turning to FIG. 2, a masking film 200 can be aligned with the substrate 100. The film 200 can include multiple mask regions 210,220 which can be substantially opaque to an exposing light source. The first mask region 210 can be aligned with the first region 120, which is to be printed with the UV ink through, for example, a 305 mesh. Similarly, the second mask region 220 can be aligned with the second region 130, which is to be printed with the solvent based ink using a mesh having, for example, a 195 mesh.

Figure 3:
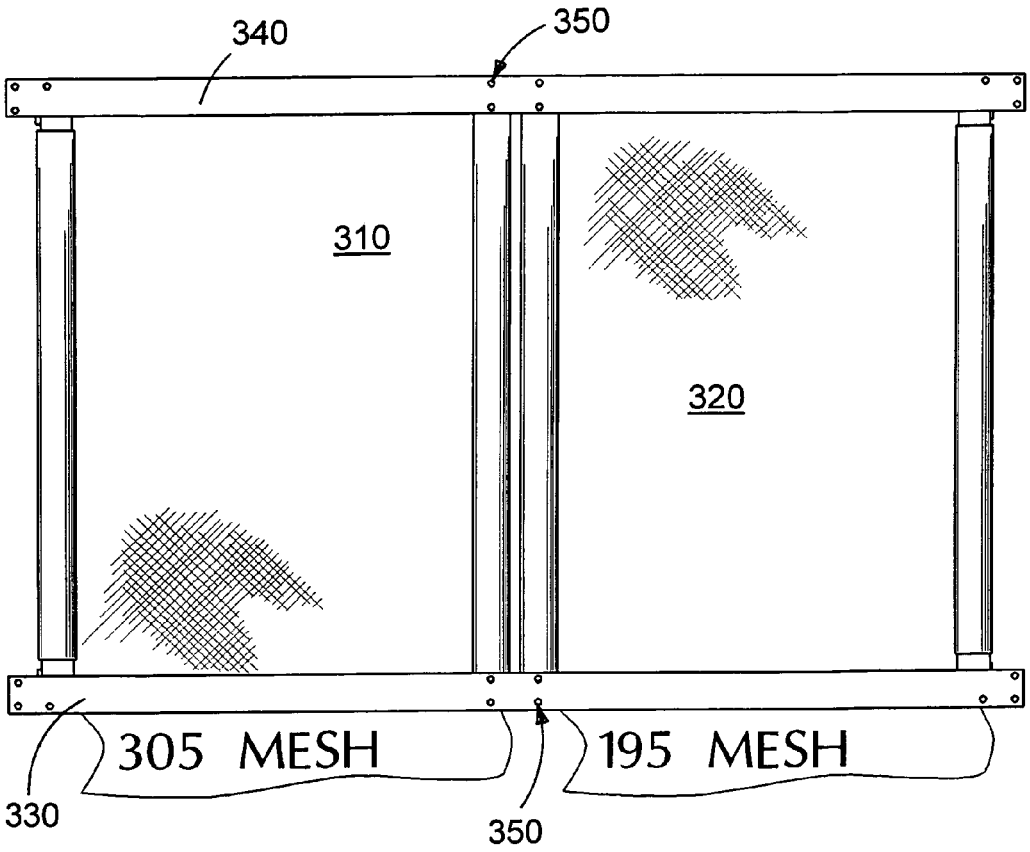
FIG. 3 is a plan view of two screen printing frames affixed to one another.

Two frames 310,320 having 195 mesh screen and 305 mesh screen, respectively, can be positioned next to one another as shown in FIG. 3. Locking bars 330,340 can be placed on across the upper and lower runs of frames 310, 320. The locking bars can be removably attached to the frames 310,320 with bolts 350, clamps, or other known means. The frames 310,320 can have taps, holes, notches, or known structures for receiving the fastening mechanism by which the locking bars 330,340 are attached to the frames 310, 320. The locking bars can be used to inhibit or prevent relative movement of the frames during subsequent masking and exposure operations.

Figure 4:
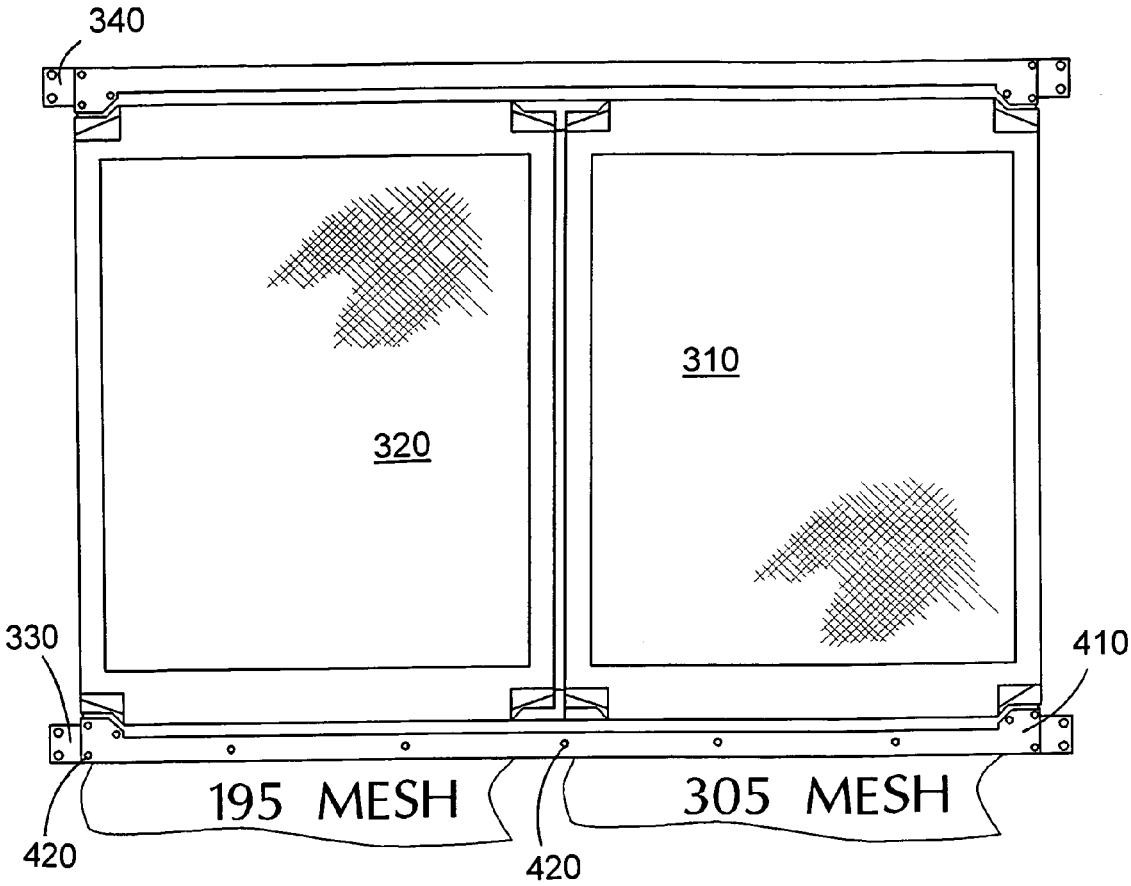
FIG. 4 is a plan view of the reverse side of the two frames of FIG. 3 after a pin register bar has been attached thereto.

The frames 310,320 can be rotated such that their opposing faces are direct upward, as shown in FIG. 4. A pin register bar 410 can be fastened to a position parallel and adjacent to the locking bar 330. The register bar 410 can have pins 420 projecting upwardly therefrom. The pins 420 can be aligned with apertures on or edges of the masking film 200 to assist in placing the film 200 in correct register relative to the frames 310, 320.

Turning to FIG. 4, the masking film 200 can be placed over both frames 310, 320. Those skilled in the art will appreciate that the masking film 200 depicted here has been turned 180 degrees relative to the position depicted in FIG. 2 before being placed on the frames 310, 320. Edges, indicia, or apertures in the film 200 can be aligned with pins on the register bar 410 in order to improve registration and orientation of the masking film relative to the frames 310, 320.

Figure 5:
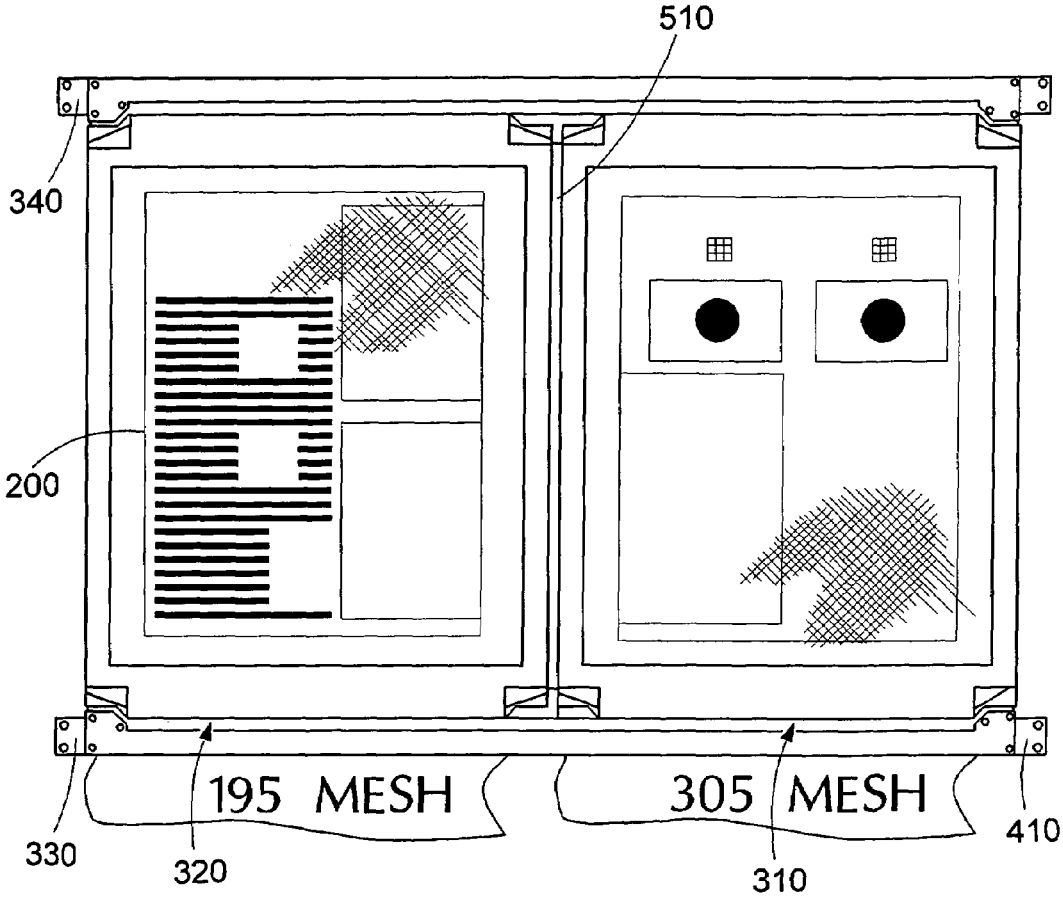
FIG. 5 is a plan view of the frames of FIG. 4 after the masking film has been affixed thereto.

The film can be affixed to the frames by taping or other means, as shown in FIG. 5. Afterwards, the film can be separated, as by cutting, along the seam 510 between the two frames.

Figure 6:
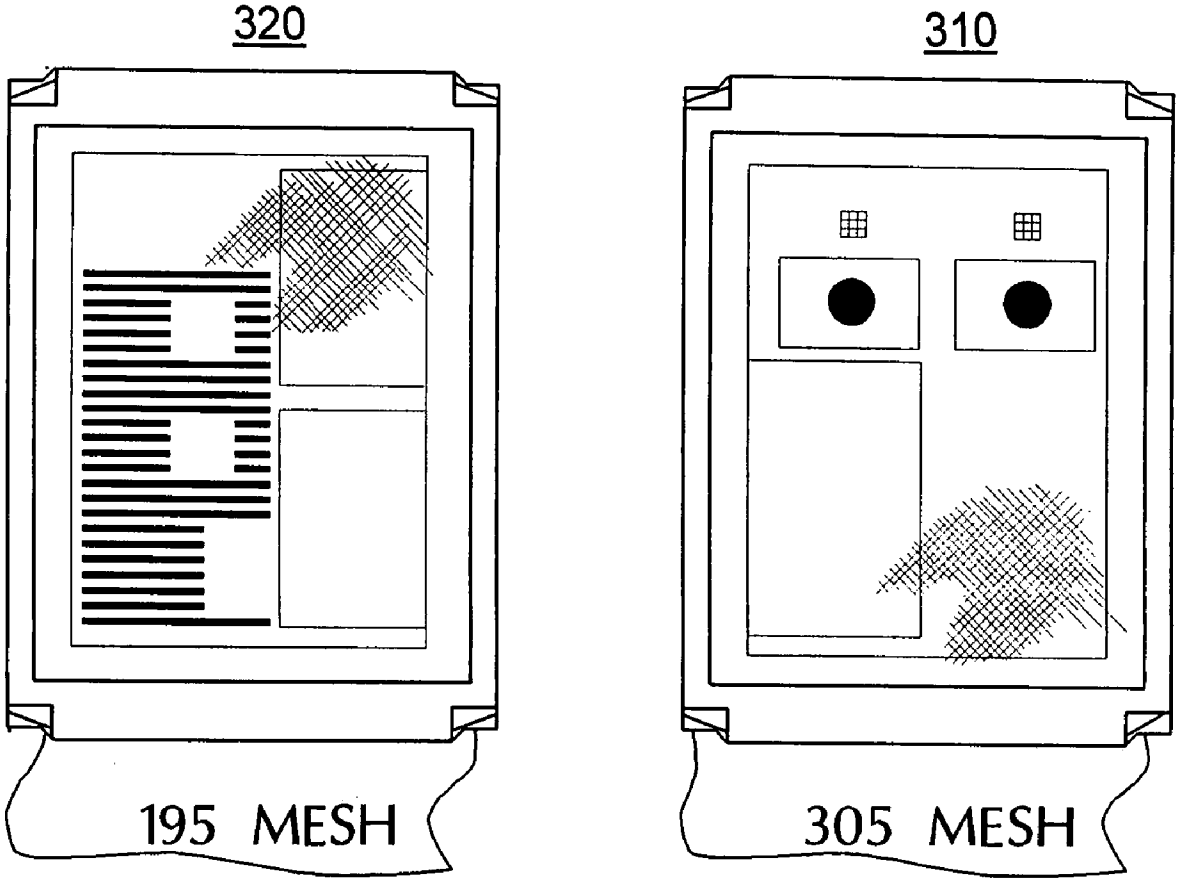
FIG. 6 is a plan view of the frames of FIG. 5 after they have been separated.

Referring now to FIG. 6, the pin register bar 410 and locking bars 330, 340 can be removed prior to exposure. The frames 310, 320 can be individually or simultaneously exposed to harden the unmasked emulsion in the screens. As noted above, the UV and solvent based inks to be used in this exemplary process can be applied with different meshes, and the meshes can require different exposure times and conditions. In such circumstances, it is particularly useful to separate the frames 310, 320 prior to exposure.

Figure 7:
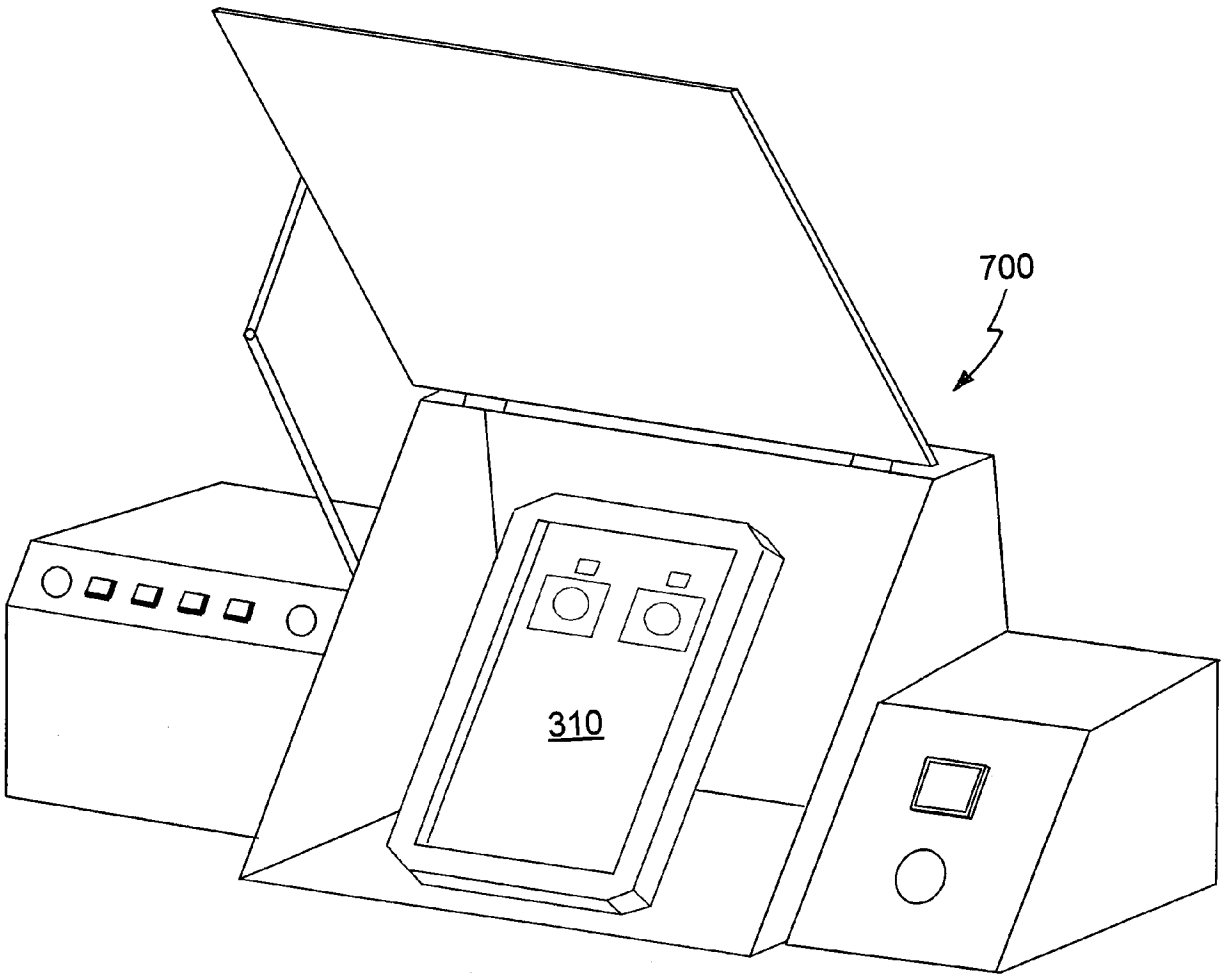
FIG. 7 is a perspective view of one of the frames of FIG. 6 placed in an exposure unit.

Referring to FIG. 7, each frame can next be placed in an exposure unit 700 to harden the unmasked emulsion. After exposure, the unhardened emulsion can be removed from the masked portions of the screens according to known methods.

Figure 8:
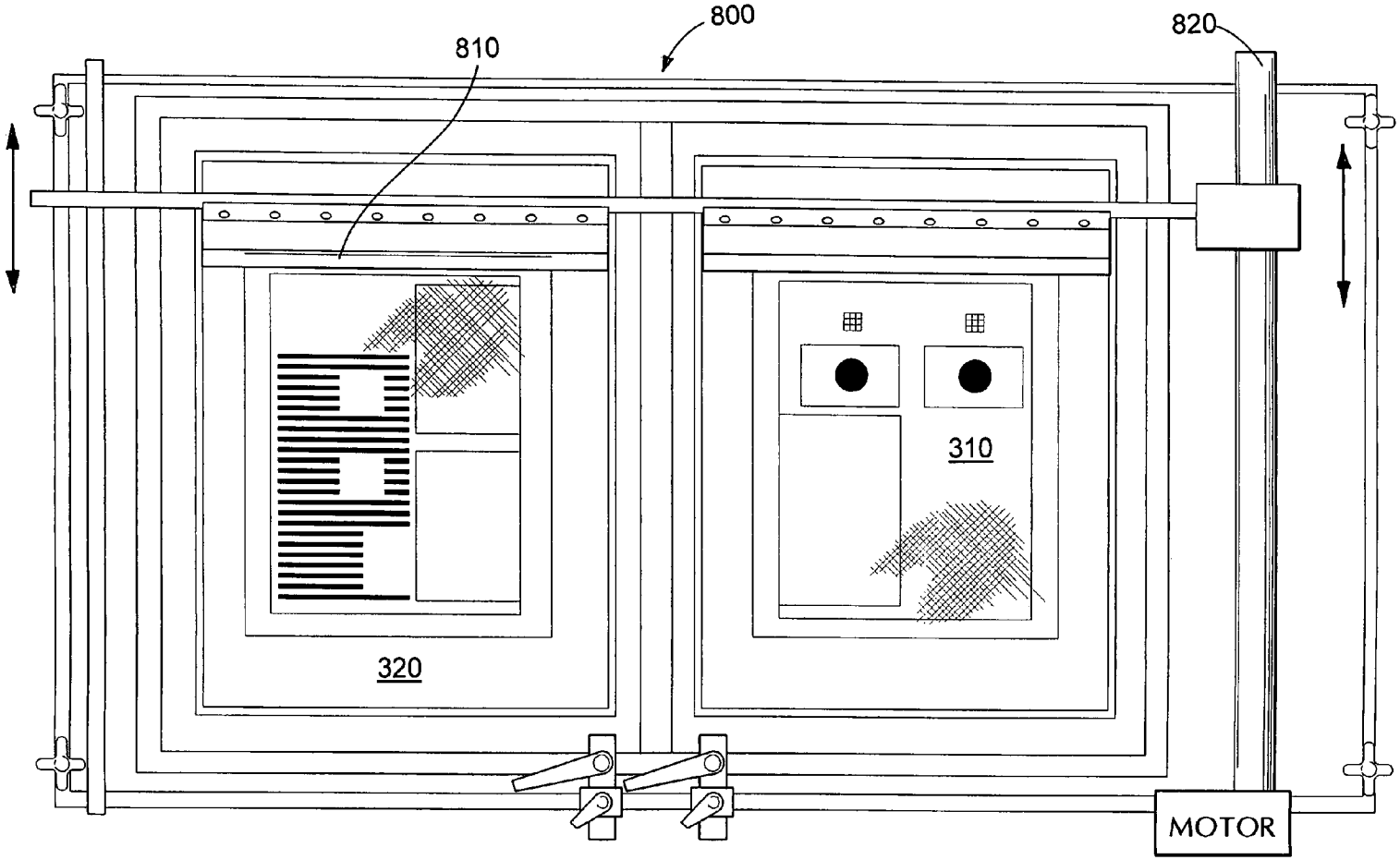
FIG. 8 is a plan view of a screen printing apparatus into which the frames of FIG. 6 have been mounted.

FIG. 8 depicts a screen printing apparatus 800 after the frames 310, 320 have been mounted therein. The apparatus 800 can include wipes 810 which are reciprocated along rack 820. Those skilled in the art will appreciate that, because the frames were prepared according to the method described above, it is possible to print the litho stock 100 in a single pass with two images in substantially perfect register even though the two images are printed with different inks through different meshes.

Figure 9:
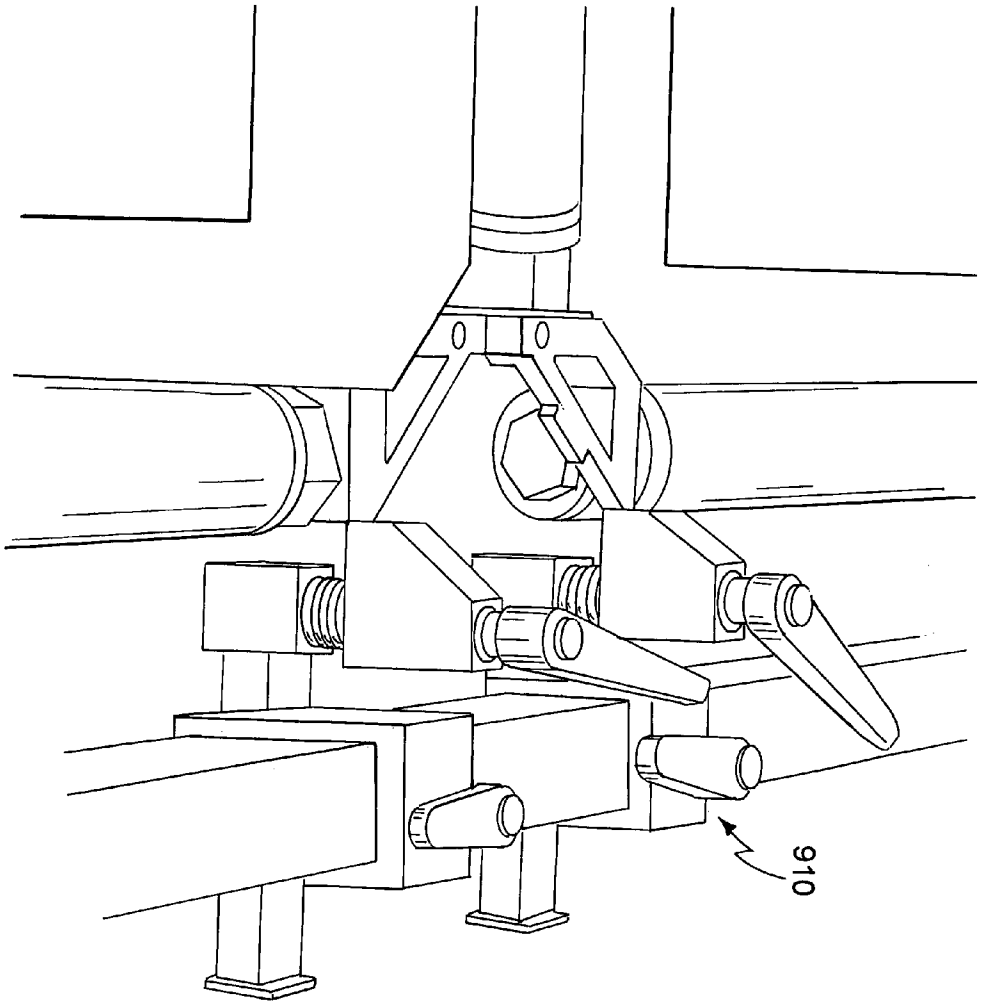
FIG. 9 is a close-up view of the mounting mechanism in the screen printing apparatus of FIG. 8.

The frames 310,320 can be mounted in the screen printing apparatus 800 with clamps 910, as shown in FIG. 9. Alternately, the frames can remain mounted to the locking bars 330, 340 during the exposure and printing periods or they can be remounted to the locking bars 330, 340 after exposure but prior to printing. A preferred printing method comprises placing two screens that each have a specified mesh count on a screen printing mount (e.g., printer carriage of a screen printing machine), and pressing one type of ink through one screen, and another and different type of ink through the other screen. The screens are preferably adjacent to each other and are both in substantially even plane. Pressing the inks through the meshes produces the patterned images on the substrate.

Those skilled in the art will further appreciate that the foregoing techniques and apparatus can be adapted to many applications according to the teachings set forth herein. By way of non-limiting example, the process can be used to print on other substrates, such as textiles, other paper products, metals, films, and other polymeric substrates. The substrate need not be laid out to permit printing with multiple different inks in a single screen printing pass. Similarly, the substrate can be optionally printed with other images by other processes either before or after the screen printing techniques discussed the foregoing illustrative example.

The masking film can be a single, unitary film or can be comprised of multiple pieces abutted or affixed to one another. The film need not have register apertures adapted to mate with pins in the register bar. The film can have other alignment means such corner cuts, notches, lines, straight edges, or other indicia. Alternatively, the film can be provided with no designated registration indicia. The film can be fabricated from any suitable polymer, including PET, PMMA, PVC, polycarbonate, polyurethane, or the like. The masking film can have any configuration appropriate to obtain the desired mesh arrangement. For example, the areas to be masked can be transparent, rather than opaque, to a given type of exposure light, such as UV light. Alternately, the masking film can have apertures therein to permit removal of emulsion at selected locations by a chemical process.

The system can involve a variable number of frames having desired dimensions and shapes. Multiple meshes can be mounted in a single frame, if desired. The frames can be placed in any orientation relative to one another. Any suitable type of locking mechanism can be used to hold the frames relative to one another. For example, the frames can be received in or on a table having appropriate receptacles, flanges or pins. Clips, clamps, or pin bars could also be used, by way of example. The pin register bar can be substituted with any device configured to cooperate with the selected registration indicia to obtain improved registration or orientation.

The film need not be separated after application to the frames. For instance, the film can be separated prior to application to the frames and aligned with the frames with registration indicia on each of the film pieces. Any suitable means can be used to hold the film in place during masking or exposure, including but not limited to tape, clips, and other mechanical-affixation.

As noted above, the frames can remain affixed to one another during any or all of the masking, exposure, or printing steps. For instance, the frames can remain attached during exposure but be separated prior to mounting in the screen printing apparatus. Alternately, the frames can be separated for individual exposure, whereupon the frames are reattached to improve registration in the screen printing apparatus. The frames can be permanently affixed to one another or the screens could likewise be part of a single "two window" frame, either of which may necessitate additional steps to ensure proper exposure.

Many suitable inks can be used in accordance with the foregoing teachings. For instance, water-based, solvent-based, plastisols, and light-curable inks can be used in the instant processes. Inks may also include, for example, solid particles such as polymeric particles or decorative particulate. In such cases, an ink can act as a carrier for the particulate.

The meshes or screens can be constructed of silk, polyester, cotton organdy, silk, nylon, or other suitable materials. Multiple mesh types or pitches can be incorporated into a single frame according to known means. Any desired pitch can be selected consistent with the foregoing teachings.

The screens can be patterned by exposure, chemical processing or other known means. Those skilled in the art will understand that the masking film should be configured according to the selected patterning technique. The screens can also have any desired shape, including an arcuate shape.

The screen printing apparatus can be configured to receive any or all of the variants described above. For example, the apparatus can be adapted to hold a unitary frame structure having three or more sections of mesh, each having a different mesh adapted for application of a different ink. The frame can include members between each of the mesh sections. The apparatus can include any desired number of wipes. If desired, a single wipe can be used to apply ink through a multiplicity of mesh types. As another example, multiple wipes can be used within a single frame. In such embodiments, it is useful to contour the wipes to prevent inks from migrating into an adjacent mesh area. Frames can be placed in a printing press together or individually, and adjusted longitudinally and/or laterally for registration.

Although a wide variety of mesh counts can be used, from about 50 to about 500, mesh counts between about 185 and 380 openings per inch are preferred. Where a mesh is intended for use with a solvent-based ink, the mesh count is preferably between about 195 and about 305. For water-based inks, the mesh count is preferably between about 195 to about 255. For UV-curable inks, the mesh count is preferably between about 330 to about 380. The ranges, however, can be adjusted, depending on the viscosity of an ink, or a desired print effect. Other types of inks (e.g., plastisols) can be used, and the screens can then be adjusted to have a mesh count that corresponds to the ink type.

A number of embodiments of the invention have been described. Nevertheless, it will be understood that various modifications may be made without departing from the spirit and scope of the invention. Accordingly, other embodiments are within the scope of the following claims.

What is claimed is:

1. A process for preparing screens comprising:

providing a first screen having a first pitch and adapted to receive a first ink;

providing a second screen having a second pitch and adapted to receive a second ink having a base different from said first ink, wherein said second pitch is different from said first pitch;

securing the screens relative to one another;

applying at least one mask to at least a portion of both the first and second screens after securing the screens relative to one another, said at least one mask including masking portions aligned with areas of screen through which images are to be printed through the screens.

2. The process of claim 1, further comprising exposing said first and second screens through the mask so that the screens are patterned with images in substantial registration.

3. The process of claim 2, further comprising:

removing at least a portion of the mask from the exposed screens; and removing unhardened emulsion from the first and second screens.

4. The process of claim 1, wherein the screens are bounded by frames and wherein the screens are secured in a substantially fixed position relative to one another with a locking member.

5. The process of claim 1, wherein the mask is comprised of a single polymeric sheet.

6. The process of claim 1, further comprising separating the mask between the first and second screens.

7. The process of claim 1, further comprising exposing said screens simultaneously.

8. The process of claim 1, further comprising attaching a registration member to the screens to assist in applying the mask to the screens.

9. A screen printing apparatus comprising:

at least one mounting member to receive adjacent first and second frames;

the first frame having a first screen with a first pitch, the first screen being patterned with a first image to be printed with a first ink;

the second frame having a second screen with a second pitch, the second screen being patterned with a second image to be printed with a second ink having a base different from that of the first ink, wherein the second pitch is different from the first pitch;

wherein the first and second images are in substantially complete registration when the first and second frames are received by the at least one mounting member.

10. The apparatus of claim 9, further comprising at least one wipe member to apply the first ink through the first screen and to apply the second ink through the second screen.

11. The apparatus of claim 10, wherein the at least one wipe member is operable to apply the first and second inks in a single pass so as to print first image in substantial complete registration to the second image.

12. The apparatus of claim 9, wherein when the first and second frames are received by the at least one mounting member, the first and second screens are adjacent to one another and are in substantially even plane relative to one another.

13. The apparatus of claim 9, wherein the frames are rigidly attached to one another by a locking member, the first and second frames further comprising at least one alignment means for receiving the locking member during a masking operation.

14. The apparatus of claim 13, wherein the first and second frames further comprise at least one means for receiving a registration member to assist alignment during the masking operation.

15. The apparatus of claim 9, wherein the first ink is solvent-based and the second ink is UV curable or water-based.

16. The apparatus of claim 9, wherein the mounting members include clamps to retain the frames.

17. A method of printing images on a substrate comprising:

engaging a first screen with a printer apparatus, the first screen having a first pattern formed thereon and a first mesh count;

engaging a second screen with the printer apparatus adjacent to said first screen, the second screen having a second pattern formed thereon and a second mesh count, wherein said second mesh count is different from said first mesh count and wherein the second pattern is in substantially complete registration with said first pattern; and simultaneously applying a first ink through said first screen and a second ink through said second screen.

18. The method according to claim 17, wherein said second ink has a different base than the first ink.

19. The method according to claim 18, wherein the first ink has a base selected from a group consisting of a water-based ink, a UV-curable ink, and a solvent-based ink.

20. The method of claim 17, further comprising causing a wipe apparatus to force the first ink through the first screen and to force the second ink through the second screen, wherein the wipe apparatus comprises a first wipe portion to apply the first ink through the first screen having the first mesh count and a second wipe portion to apply the second ink through the second screen having the second mesh count.

* * * * *